United States Patent [19]

Sedgwick et al.

[11] 4,254,591

[45] Mar. 10, 1981

[54] INTERNAL LAPPING TOOL

[76] Inventors: Julius P. Sedgwick, 15911 Marigold Ave., Gardena, Calif. 90249; Lindy Helms, 12103 Gard Ave., Norwalk, Calif. 90650

[21] Appl. No.: 53,288

[22] Filed: Jun. 28, 1979

[51] Int. Cl.[3] ..... B24B 33/02

[52] U.S. Cl. ..... 51/355; 51/338; 51/DIG. 6

[58] Field of Search ..... 51/330, 331, 338–355, 51/206 R, 281 P, 290, 294, 302, 303, 317, DIG. 6, 212; 408/145

[56] References Cited

U.S. PATENT DOCUMENTS

| | | | |
|---|---|---|---|
| 2,195,055 | 3/1940 | Wallace | 51/349 X |
| 2,309,485 | 1/1943 | Wallace | 51/349 X |
| 2,350,969 | 6/1944 | Sunnen | 51/355 |
| 2,376,851 | 5/1945 | Sunnen | 51/355 |
| 3,075,323 | 1/1963 | Weir | 51/338 |
| 3,225,496 | 12/1965 | Sunnen | 51/355 |
| 3,553,905 | 1/1971 | Lemelson | 51/206 R |
| 3,800,482 | 4/1974 | Sunnen | 51/339 |
| 3,972,161 | 8/1976 | Zoiss | 51/206 R |

FOREIGN PATENT DOCUMENTS

| | | | |
|---|---|---|---|
| 5374 | 11/1941 | Netherlands | 51/342 |

*Primary Examiner*—Gary L. Smith
*Assistant Examiner*—Robert P. Olszewski
*Attorney, Agent, or Firm*—John T. Matlago

[57] ABSTRACT

An internal lapping tool comprises a steel mandrel having a cast iron generally cylindrical head welded on the front and thereof. The head is formed with two spaced arcuate lapping faces opposite a longitudinal slot which carries a cast iron insert providing a third arcuate lapping face. A wedge member slideably mounted for longitudinal movement in the mandrel provides for moving the insert radially. The three arcuate lapping faces on the rotating head provide a three point contact on the wall of a hole being lapped, thereby effectively producing a round mating form as desired for lapping. Futhermore, as the arcuate faces wear and the hole enlarges during the lapping operation, the arcuate lapping faces are kept snugly at all times against the cylindrical wall of the hole being lapped by the longitudinal positive feed of the wedge member.

12 Claims, 10 Drawing Figures

INTERNAL LAPPING TOOL

BACKGROUND OF THE INVENTION

This invention relates to machine tools and more particularly to adjustable lapping tools for lapping the inside diameters of small holes to extremely close tolerances.

In the continuing effort to increase the life of rotating parts which are subject to wear, there is a need to be able to quickly size and finish holes by lapping them to a greater accuracy than heretofore provided. For example, it is now required that holes for valves and other hydraulic parts in the aircraft and space industries be lapped to an accuracy of as great as five to ten millionths of an inch so as to create a maximum percentage of bearing area. Thus, as the tolerances on the job become closer, it becomes more essential that the tooling used for internal lapping comes closer to meeting the ideal requirement of the bore.

Previously in the art, internal lapping tools have been made by providing a cast iron sleeve with a tapered hole therethrough and a helical slot therealong. The tapered hole enables the sleeve to be mounted on a mated tapered mandrel. The advancement of the sleeve on the tapered mandrel to enlarge its diameter during the coarse of the lapping operation is accomplished by manually striking the end of a lap expander positioned adjacent the sleeve or by manually operating a screw expansion device. Although this appears to provide a uniform enlargement of the diameter throughout the cylindrical lapping sleeve as needed for accurate lapping, actually such a construction and structural arrangement is ineffective when it is desired to accurately size the internal wall of a hole to a tolerance of a few millionths of an inch. This is because of minute variations of expansion that such uncoiling produces along the length of the sleeve. Furthermore, such a lapping tool has the disadvantage that the cylindrical lapping surface of the sleeve is not continually kept snugly up against the wall of the hole as the sleeve wears and the hole enlarges but must be incrementally adjusted every so often by manually striking the end of the lap expander, for example.

SUMMARY OF THE INVENTION

The lapping tool of the present invention comprises a soft cast iron generally cylindrical head welded to the end of a steel mandrel. The head is formed with two integral arcuate lapping faces spaced about the circumference thereof and with a slot generally opposite the two arcuate lapping faces in which a soft cast iron insert having an arcuate lapping face is carried. A wedge member slideably mounted for longitudinal movement in the mandrel provides for engaging the insert and causing it to be moved radially outwardly. The rear end of the mandrel is inserted and held in the chuck of a standard machine, not a part of this invention, which machine provides for simultaneously rotating the mandrel at a suitable speed and for longitudinally feeding the wedge in a controlled manner relative to the mandrel to radially lift the insert and thereby expand the diameter of the lapping tool. A hole to be lapped in a workpiece is first honed to within two to five ten thousandths of an inch of the desired size and is then lapped by the lapping tool of the present invention to within two to three millionths of an inch of the desired size.

The effectiveness of the lapping tool of the present invention results from the fact that the three arcuate lapping faces on the lapping head have a three point contact within the hole being lapped. The contact may initially be only for a small circumferential portion of each of the three arcuate lapping faces, but due to wear as the lapping operation continues, the lapping area increases on each of the three faces. Furthermore, the effectiveness of the lapping tool of the present invention results from the speeding up of the lapping operation and the assurance of a desired roundness and straightness in the hole by maintaining the three arcuate lapping faces snugly up against the wall of the hole at all times while the lapping operation proceeds.

Accordingly, one of the objects of the present invention is to provide a lapping tool for sizing and finishing holes to within a few millionths of an inch.

Another object of the present invention is to provide an internal lapping tool that speeds up the lagging of holes to accurate dimensions.

Another object of the present invention is to provide an adjustable internal lapping tool wherein the round mating form required for lapping is obtained by a rotating cast iron lapping head having three spaced arcuate lapping faces, one of which is radially movable, to thereby provide a three point contact within the inner surface of the hole in the workpiece being lapped.

With these and other objects in view, the invention consists of the construction, arrangement, and combination of the various parts of the device, whereby the objects contemplated are attained, as hereinafter set forth, pointed out in the appended claims, and illustrated in the accompanying drawings.

DESCRIPTION OF THE PREFERRED EMBODIMENTS

Figures 1, 2, 2A, 3, 4, 5:
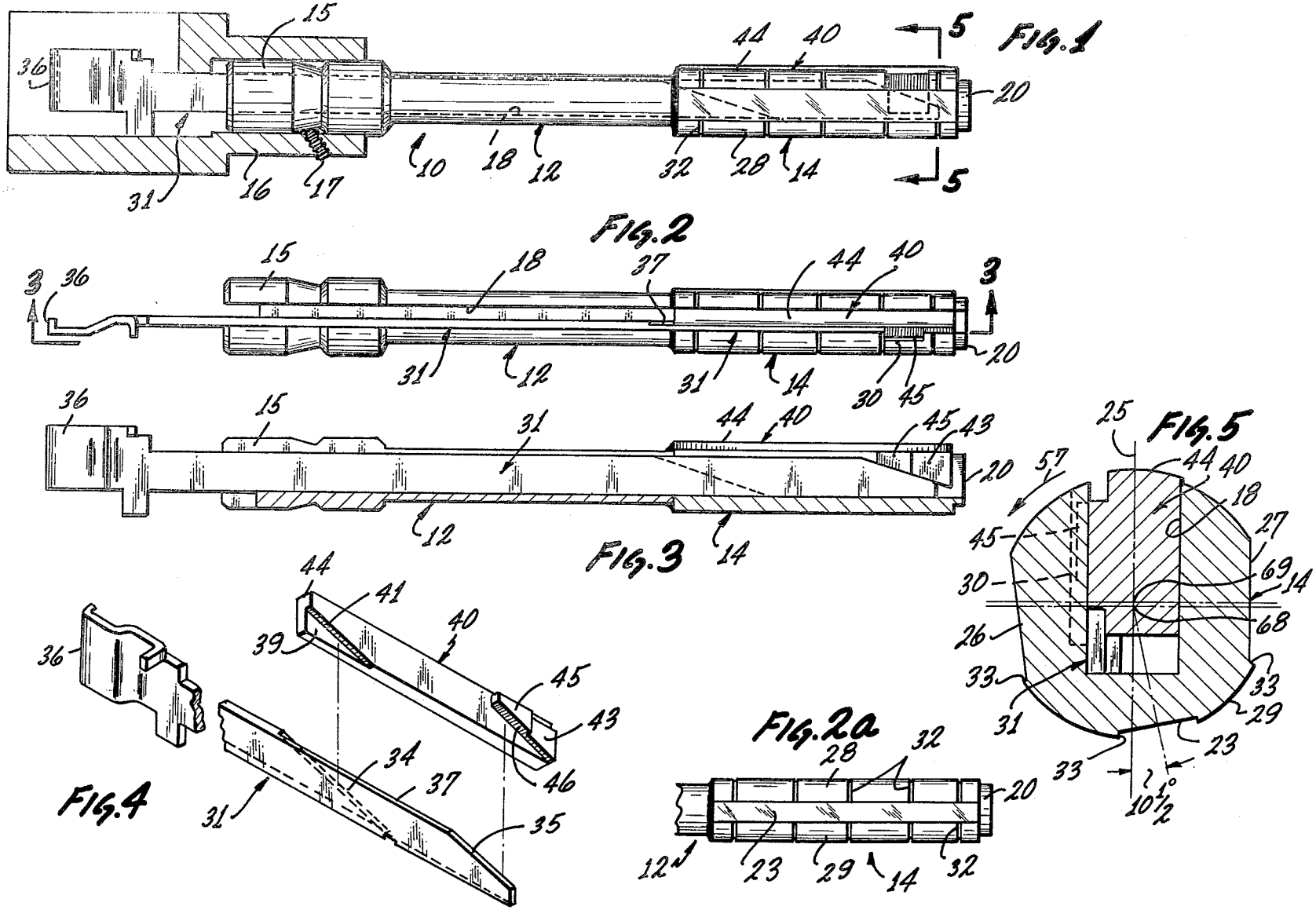
FIG. 1 is a longitudinal side view of a lapping tool embodying the present invention.
FIG. 2 is a longitudinal plan view of the lapping tool shown in FIG. 1.
FIG. 2*a* is a bottom view of the lapping head.
FIG. 3 is a longitudinal sectional view of the lapping tool taken along line 3—3 of FIG. 2.
FIG. 4 shows perspective views of the insert and the wedge member.
FIG. 5 is an enlarged sectional view of the lapping tool as taken along line 5—5 of FIG. 1.

Referring to the drawings, the lapping tool 10 of the present invention comprises a steel mandrel 12 having a soft cast iron generally cylindrical head 14 of a larger diameter welded to the front end thereof. As best shown in FIGS. 2 and 5, a longitudinal slot 18 extends throughout the length of the mandrel 12 and the head 14. The sides of the slot 18 are parallel and the bottom thereof is square.

As shown in FIG. 5, which is a cross sectional view taken on line 5—5 of FIG. 1, the head 14 has its periphery longitudinally machined to form a flat recess 23 extending normal to a radius having an angle of substantially 10 ½ degrees with a plane 25 which passes through the longitudinal axis of the head and is parallel to the sides of slot 18. The head 14 has both its side peripheries also longitudinally machined to provide flat recesses 26 and 27 thus leaving arcuate lapping faces 28 and 29 on either side of the flat recess 23 and generally opposite the opening of slot 18 on the head. It should be noted that the arcuate lapping face 28 is slightly circumferentially wider than the arcuate lapping face 29. It should be further noted that each of the edges 33 of the arcuate faces 28 and 29 is machined so as to extend along a radius of the head. Furthermore, as shown in FIG. 2*a*, a plurality of spaced radial grooves 32 are provided along integral arcuate lapping faces 28 and 29 of head 14.

An elongated wedge member 31 made of a thin strip of sheet steel is mounted within the slot 18 to slide against the bottom and one side thereof. The wedge member 31 has approximately half the thickness of its front portion 37 machined away to form a first inclined cam surface 34 and has the upper portion of its front end cut away to form a second parallel inclined cam surface 35. The rear of the wedge member 31, which extends beyond the rear of the mandrel 12, is formed with a hook 36.

A cast iron insert 40 having a length equal to the length of the head 14 is positioned in the slot 18 of the head on the side of the wedge member 31. As shown in FIG. 4, one side of the insert 40 is flat and the other side is formed with a flat recess portion 39 on the bottom rear corner thereof to define an inclined cam surface 41 and with a thickened portion 43 on the front upper corner thereof to form a parallel inclined cam surface 46.

The insert 40 is mounted in the slot 18 with its flat side slideably contacting a side of the slot 18 and with its other side contacting the side 37 of the wedge member 31 such that the inclined cam surfaces 41 and 46 thereon respectively engage the inclined cam surfaces 34 and 35 on the wedge member 31.

When the insert 40 is so mounted in the slot 18, a key 45 provided on the thickened portion 43 fits into a keyway 30 machined on the front end of the head 14. The outer surface of the insert 40 forms an arcuate lapping face 44.

It should now be clear that the insert 40 and the wedge member 31 have a sliding fit within the slot 18 so that when the wedge member 31 is moved longitudinally, the insert 40 is moved radially to thereby vary the diameter of the lapping head 14. The combined widths of the three spaced arcuate lapping faces 28, 29 and 44 is equal to approximately 120 degrees.

The mandrel 12 has an enlarged base 15 turned on the rear end thereof which is fitted and held by a set screw 17 in an axial bore of a chuck 16 connected to the end of a spindle of a standard machine of any suitable type as illustrated in U.S. Pat. No. 2,070,381. Such a standard machine, which is not a part of this invention, provides for both rotating the mandrel 12 at a suitable speed and for engaging the hook 36 on the end of the wedge member 31 to control the longitudinal feed, and therefore the expansion of head 14.

Prior to performing a lapping operation, with the lapping tool 10 assembled and mounted on the chuck 16 of the standard machine, the lapping head 14 is dressed in a well known manner to a predetermined size by use of a truing sleeve. The truing sleeve which is in the form of an external lapping tool (not shown) is charged with an abrasive compound and manually positioned over the end of the head 14 while the wedge member 31 is moved to the left so that the face 44 of insert 40 can be retracted. Then, by use of the standard machine, the wedge member 31 is advanced while the mandrel is rotating in the direction indicated by arrow 57 in FIG. 5, until the arcuate lapping face 44 on insert 40 contacts the inner lapping face of the manually held truing sleeve. This causes the three arcuate lapping faces 28, 29 and 44 of the head 14 to be lapped straight and parallel to each other and radiused to a predetermined size corresponding to that to which the hole 65 in a workpiece 63 (FIG. 9) is to be lapped.

To use the internal lapping tool 10 to lap the hole 65 in the workpiece 63, each of the three arcuate lapping faces 28, 29 and 44 is charged with an abrasive compound by use of a brush, for example. Then, with the wedge member 31 moved to the left so that the face 44 of the insert 40 is retracted, the workpiece 63 is manually positioned with its hole 65 to be lapped over the lapping head 14. Inasmuch as the wall of hole 65 in the workpiece 63 has already been ground and honed to within 0.0002 to 0.0005 inches of the desired size, the head 14 with its retracted insert 40 has an easy fit within the hole 65.

Figure 9:
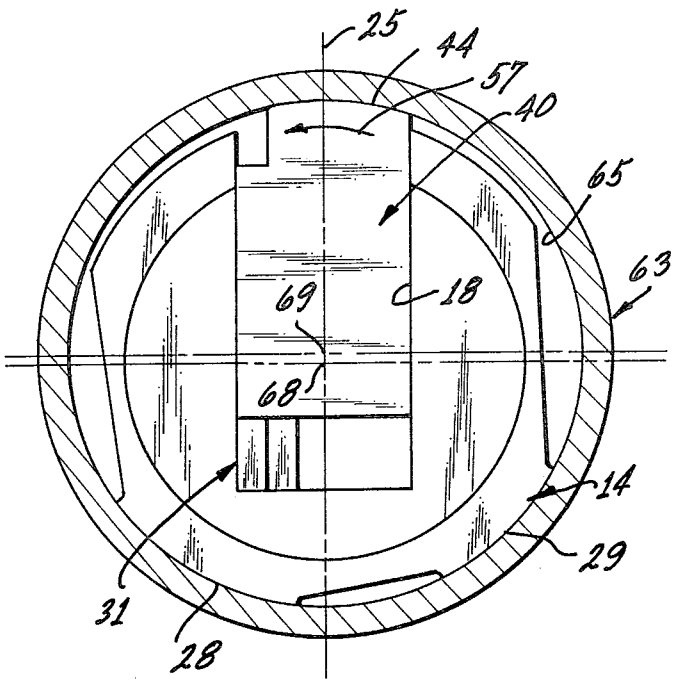
FIG. 9 is an enlarged end view of a workpiece having a hole with the lapping tool of FIG. 1 positioned therein.

Now then, with the workpiece manually held on the head 14, the operator of the standard machine simultaneously causes the mandrel 12 to rotate the wedge member 31 to be initially rapidly moved forward until the arcuate lapping face 44 of the insert 40 and the two integral arcuate lapping faces 28 and 29 on the head 14 just make contact with the interior cylindrical wall of the hole 65. It should be appreciated that as the arcuate lapping face 44 on the insert 40 initially engages the wall of the hole 65 to be lapped, the diameter of the head 14 expands such as to bring the integral arcuate lapping faces 28 and 29 into contact with the wall of the hole 65 and thereby equalize the pressure between the three arcuate lapping faces and the wall of hole 65. When this occurs, the center 69 of the expanded head 14, or the working axis, is offset from the axis 68 of the mandrel 12, as illustrated in FIG. 9. The standard machine then provides for slowly feeding the wedge member 30 so as to slowly expand the diameter of the mating form, determined by arcuate lapping faces 28, 29 and 44, a predetermined distance which represents the amount of stock to be removed from the hole by lapping. The rotation of the insert 40 is in the direction indicated by the arrow 57 in FIG. 9 so that the lapping face 44 of the insert follows the center plane 25.

Note that the construction and arrangement of the present invention provides for adjusting the pressure of the wedge member 31 on the movable insert 40, that is, moving the wedge member 31 longitudinally in the slot 18 of the mandrel 12, while the mandrel 12 is being rotated.

It should be appreciated that although the rotating lapping tool 10 initially has only a portion of the area of each of its arcuate lapping faces 28, 29 and 44 in contact with the cylindrical wall of the hole 65, nevertheless, these three arcuate lapping faces at all times effectively produce a truely round mating form, as desired for lapping. Moreover, this truely round mating form will be effective on the cylindrical wall of the hole 65 irrespective of any out-of-roundness or error in straightness conditions on the three arcuate lapping faces or the hole being lapped. For example, if one of the three arcuate lapping faces 28, 29 and 44 should happen to wear faster than the others, constant pressure between all three of the arcuate lapping faces and the inner cylindrical surface being lapped will be maintained through the shifting of the working axis 69 of the lapping head 14 under the force of the movable arcuate lapping face 44. The three arcuate lapping faces 28, 29 and 44 are thus arranged circumferentially and with such widths that the radial forces created by engagement of the arcuate lapping face 44 within the hole 65 will be substantially evenly uniformly distributed throughout the three lapping faces so that they will wear evenly. Thus, the arcuate lapping face 28 on head 14 is made a little wider circumferentially then arcuate lapping face 29 because the radial force created by insert 40 is greater thereon. The combined circumferential widths of the three spaced arcuate lapping faces 28, 29 and 44 is equal to approximately one third the circumference of the head 14.

It is understood that the workpiece 63 is being manually held to shift relative to the rotating axis 68 of the mandrel 12 of the lapping tool 10 so that the axis of the workpiece 63 aligns itself to the working center 69 of the three arcuate lapping faces on the head 14 as the center 69 changes. In other words, the workpiece 69 is manually held in such a manner as to float on the head 14 of the rotating lapping tool 10.

Especially to be noted is that the slow feed of the wedge member 31 by the standard machine provides for maintaining the three arcuate lapping faces 28, 29 and 44 with a close fit, at all times, against the surface of the hole 65 as the arcuate lapping faces wear and the hole is enlarged by the lapping operation, so as to efficiently and quickly provide for lapping the surface of the hole to the close tolerances desired. Furthermore, it is the maintaining of the three arcuate lapping faces 28, 29 and 44 on the rotating head snugly at all times in the hole 65 being lapped, that serves to correct any out-of-roundness and errors in straightness, such as a tapered, bell mouthed, or bowed condition, that may exist therein.

it should be clearly understood that the mandrel 12 must be made of a tough and rigid metal such as steel, so as to drive the lapping head 14 without bending or twisting when pressure is applied to the movable arcuate lapping face 44 by the wedge member 31. Such twisting or rocking in the slot 18 could result in chattering or variation in the diameter along the axis of the hole being lapped. On the other hand, the three arcuate lapping faces of the head must be made of a softer metal than the metal of the workpiece with the hole to be lapped so that the abrasive material becomes temporarily embedded in the arcuate lapping faces until it is dulled or fractured from the pressure of the lapping action. It is for this reason that the lapping head 14 and the insert 40 are made of soft, closed-grained, cast iron. Note that it is very important when working with tolerances of a few millionths of an inch for the arcuate faces to be an integral part of the head 14 and the insert 40. The radial grooves 32 cut on the integral arcuate lapping faces 28 and 29 are very helpful in distributing the lapping compound over the entire length of these faces when lapping. It is noted, however, that there are no radial grooves provided on the moveable insert 40. This allows the lapping head to bridge short lands, if any, on the workpiece.

One of the advantages of the embodiment 10 of the lapping tool is that it is especially suited for lapping blind holes. When so used, the cylindrical end 20 of the head 14 is ground off so that the head can be seated in the hole in the course of the lapping operation. The fairly steep cam surfaces 34 and 35 on the wedge member 31 and the mating cam surfaces 41 and 46 on the insert 40 provide for the desired radial movement of the insert 40 to be obtained by a relatively short axial movement of the wedge member 31. Thus, the end of the wedge member 31 need not be ground off as the blind hole being lapped enlarges.

Figure 6:
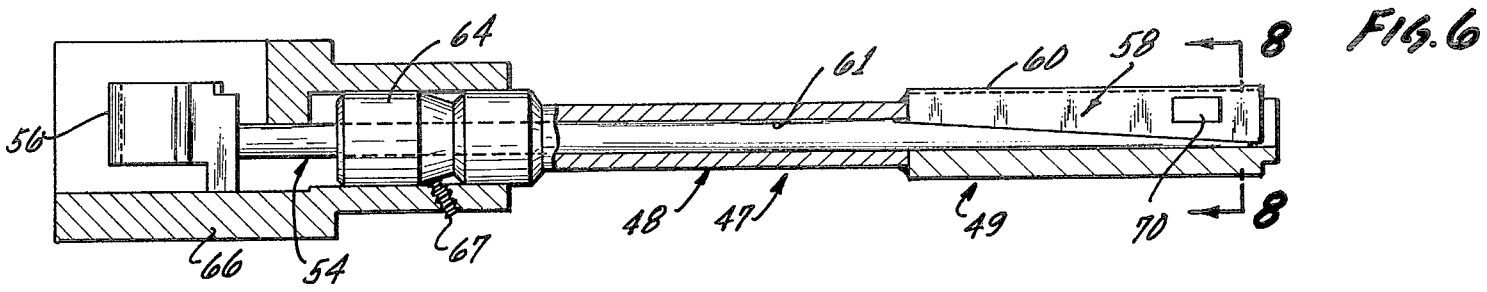
FIG. 6 is a longitudinal side view, partly in section, of another form of a lapping tool embodying the present invention.
Figure 7:
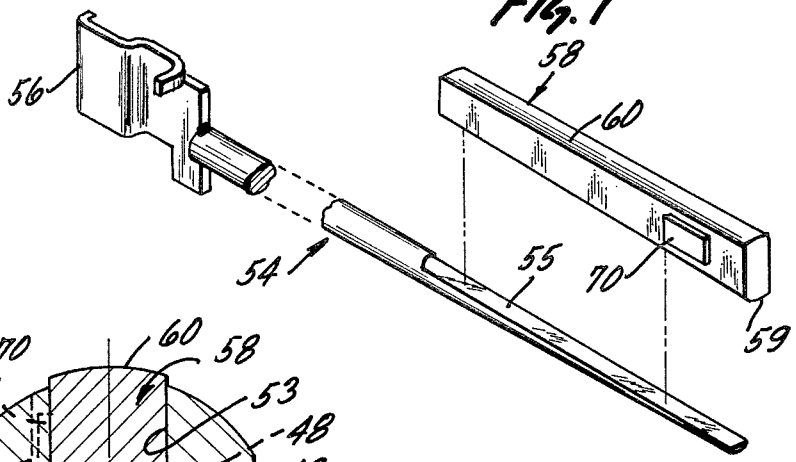
FIG. 7 is a perspective view showing the insert and the wedge member used in the embodiment of FIG. 6.
Figure 8:
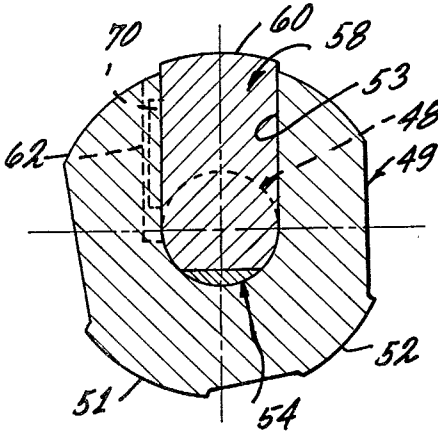
FIG. 8 is an enlarged sectional view of the lapping tool as taken along line 8—8 of FIG. 6.

Reference will next be made to FIGS. 6 to 8, inclusive, which show a modified embodiment of a lapping tool 47 wherein the means for radially moving the insert 58 is structurally different from the first embodiment 10 shown in FIGS. 1 to 6, inclusive. Thus, lapping tool 47 is provided, as before, with a cylindrical steel mandrel 48 having a cast iron head 49 welded on the front end thereof. Likewise, the head 49 is provided with spaced arcuate lapping faces 51 and 52 and an oppositely disposed slot 53 which in this embodiment has a rounded bottom. Moreover, in this embodiment, the cylindrical mandrel 48 is provided with a central bore 61 which extends throughout the length thereof and whose bottom is aligned with the rounded bottom of the slot 53 on the head 49. A wedge member 54 which is made of a solid cylindrical length of steel is provided with an inclined surface 55 on the front upper portion thereof which extends backward for a distance slightly longer then the length of the head 49. The rear of the cylindrical wedge member 54 has welded thereto a hook 56 shaped similar to the hook on the wedge member of the first embodiment 10. The wedge member 54 has a sliding fit within the central bore 61 of the mandrel 48. The insert 58 made of soft iron is positioned in the slot 53 in the head with an inclined surface 59 on the bottom thereof contacting the inclined surface 55 of the wedge member 54. The outer surface of insert 58 forms an arcuate lapping face 60. A key 70 is provided on the side of the insert 58 near the front end thereof. The key 70 resides in a slot 62 formed on the end of the head 49. The enlarged end 64 formed on mandrel 48 is inserted and held by a set screw 67 in the axial bore of a chuck 66 attached to the end of the spindle of the standard machine, as previously described.

It should now be clear that when the wedge member 54 is longitudinally advanced by the standard machine relative to the mandrel 48, the insert 58 is moved radially outwardly such that its lapping face 60 contacts and forces the expanded head 49 to be centered under pressure within the cylindrical hole being lapped, as previously described.

The embodiment of the lapping tool 47 has the advantages that it is simpler to construct and that it provides a better support for the wedge member 54 in that it prevents the rear portion thereof from possibly lifting out of the slot in the mandrel. Furthermore, the inclined surface 55 on the top of the wedge member 54 has substantially a full line of contact with the mating inclined surface 59 on the bottom of the insert 58. This full line of contact prevents any distortion of the insert 58 under lapping pressure. This feature is especially useful when the insert 58 has a long length. Otherwise, the operation of the embodiment of the lapping tool 47 is the same as that described in connection with the embodiment of the lapping tool 10 shown in FIGS. 1 to 6, inclusive.

While the foregoing disclosure has been concerned with certain illustrative embodiments, it is to be understood that the invention is susceptible of many modifications and variations in both the construction and arrangement thereof. The present invention, therefore, is not limited to the specific disclosure provided herein, but is to be considered as including all modifications and variations coming within the scope of the invention as defined in the appended claims.

What is claimed is:

1. An internal lapping tool comprising:
a mandrel;
a generally cylindrical head made of a relatively soft metal attached on the end of said mandrel;
said head having two spaced raised arcuate lapping faces formed on the periphery thereof, said lapping faces and said head formed as a single continuous element;
an insert made of the same metal as said head carried in a slot on said head substantially diametrically opposite the midpoint between said two spaced arcuate lapping faces;
said insert having an arcuate lapping face integrally formed on the periphery thereof; and
adjusting means for radially adjusting said insert to force and maintain said three arcuate lapping faces to have a close fit against the wall of a hole to be lapped as the arcuate lapping faces wear and the hole is enlarged.

2. The internal lapping tool as defined in claim 1 wherein said head and insert are made of a soft close-grained cast iron and said mandrel is made of steel.

3. The internal lapping tool as defined in claim 1;
wherein the slot in said head extends throughout said mandrel; and
wherein said adjusting means includes:
an elongated thin wedge member mounted in said slot with the lower edge thereof slideably contacting the bottom of said slot and with one side thereof slideably contacting one wall of said slot;
said wedge member having on the other side thereof first and second parallel inclined cam surfaces; and
said insert having on one side thereof first and second parallel inclined cam surfaces and being mounted in said slot with its first and second cam surfaces respectively contacting the first and second cam surfaces on said wedge member and with the other side thereof slideably contacting the other wall of said slot.

4. The internal lapping tool as defined in claim 1;
wherein the slot in said head has a rounded bottom; and
wherein said adjusting means includes a bore extending throughout said mandrel with its bottom aligned with the rounded bottom in said slot;
a control rod having an inclined surface on the top of the front portion thereof slideably mounted in said bore;
said insert slideably fitted in the slot in the head and having an inclined surface on the bottom thereof slideably contacting said inclined surface on said mandrel.

5. The internal lapping tool as defined in claim 1 wherein said head is provided with a flat recess on the bottom thereof opposite said slot, said bottom flat recess being disposed normal to a radius of said head having an angle of approximately 10½ degrees with a plane passing through the center of said head and parallel to the sides of said slot, and with flat recesses on the sides thereof to thereby form said two arcuate lapping faces on either side of said bottom flat recess.

6. The internal lapping tool as defined in claim 5 wherein the edges of said arcuate lapping faces are aligned with radii of said head.

7. The internal lapping tool as defined in claim 1 wherein said arcuate lapping faces on said head are provided with radial grooves spaced along the periphery thereof.

8. The internal lapping tool as defined in claim 1 wherein said three arcuate lapping faces extend over approximately one third the circumferential periphery of said head.

9. The internal lapping tool as defined in claim 1 wherein one of said arcuate lapping faces on said head is circumferentially wider than the other.

10. An internal lapping tool comprising:
a steel mandrel;
a cast iron head attached on the end of said steel mandrel;
said cast iron head having two spaced raised arcuate lapping faces thereon, said lapping faces and said head formed as a single continuous element;
a radially adjustable cast iron insert carried in a longitudinal slot in said head substantially diametrically disposed relative to a midpoint between said two spaced arcuate lapping faces;
said insert having an arcuate lapping face thereon;
a lapping compound applied to each of said three arcuate lapping faces; and
a longitudinal moveable wedge member in said mandrel for effecting the radial movement of said insert to force and maintain said three arcuate lapping faces into close contact with the cylindrical wall of a hole being lapped as the arcuate lapping faces wear and the hole is enlarged.

11. A lapping tool for use with a standard machine which will apply both rotational and longitudinal movement thereto, comprising:
a cast iron lapping head having a pair of spaced raised arcuate lapping faces thereon, said lapping faces and said head formed as a single continuous element and a slot generally diametrically disposed to a midpoint between said arcuate lapping faces;
a cast iron insert having an arcuate lapping face thereof carried in said slot;
a steel mandrel attached on the end of said lapping head;
said mandrel having located on the other end thereof engaging means for engaging to the rotational motion portion of said standard machine; and
a wedge member located within the central portion of said mandrel and having engaging means on one end thereof for engaging the longitudinal motion portion of said standard machine and having wedge means on the front portion thereof in operative engagement with said insert to expand said insert by the action of the longitudinal portion of the standard machine on said wedge member while said mandrel is rotated by the rotational motion portion of the standard machine to thereby lap the interior surface of a hole in a workpiece.

12. A method of lapping a hole comprising the steps of:
providing a soft close-grained cast iron head with two spaced raised arcuate lapping faces on the periphery thereof, said lapping faces and said head formed as a single continuous element;
providing a slot on said head generally diametrically opposite the midpoint between said two integral spaced lapping faces for carrying a soft close-grained cast iron insert with an integral arcuate lapping face on the periphery thereof;

applying a lapping compound containing a loose abrasive material to the arcuate lapping faces;

rotating said head and initially adjusting said insert radially outwardly to force said three lapping faces on said rotating head into contact with the cylindrical wall of the hole to be lapped; and lapping said hole while maintaining said three arcuate lapping faces on said rotating head in close contact with the cylindrical wall of said hole by continually adjusting said insert radially outwardly as the lapping faces wear and the hole is enlarged during the lapping operation.

* * * * *